US006241100B1

(12) United States Patent
Tanner et al.

(10) Patent No.: US 6,241,100 B1
(45) Date of Patent: Jun. 5, 2001

(54) LATERALLY REINFORCED PRODUCE ROLLER

(75) Inventors: Harvey Tanner; Max Tanner, both of Blackfoot; Danny Mitchell, Firth, all of ID (US)

(73) Assignee: E. M. Tanner & Sons, Inc., Blackfoot, ID (US)

( * ) Notice: Subject to any disclaimer, the term of this patent is extended or adjusted under 35 U.S.C. 154(b) by 0 days.

(21) Appl. No.: 09/387,639

(22) Filed: Aug. 31, 1999

(51) Int. Cl.[7] ..... B07B 13/05
(52) U.S. Cl. ..... 209/671; 209/667
(58) Field of Search ..... 209/660, 667, 209/668, 671, 672, 673, 674

(56) References Cited

U.S. PATENT DOCUMENTS

| | | | | |
|---|---|---|---|---|
| 1,498,144 | * | 6/1924 | Avery | 209/667 |
| 1,899,292 | | 2/1933 | Rienks . | |
| 2,266,506 | * | 12/1941 | Morse | 209/671 |
| 2,311,982 | * | 2/1943 | Goodrich | 209/671 |
| 2,618,385 | * | 11/1952 | Silver et al. | 209/669 |
| 2,670,846 | | 3/1954 | Rienks et al. | 209/104 |
| 2,983,376 | * | 5/1961 | Troyer | 209/627 |
| 3,519,129 | * | 7/1970 | Peterson | 209/671 |
| 3,590,993 | | 7/1971 | Baker | 209/73 |
| 3,592,249 | * | 7/1971 | Ross | 426/481 |
| 3,870,627 | | 3/1975 | Herkes | 209/3 |
| 4,538,734 | | 9/1985 | Gill | 209/668 |
| 4,557,388 | | 12/1985 | Peterson | 209/671 |
| 4,723,660 | | 2/1988 | Sjoberg | 209/622 |
| 4,795,036 | | 1/1989 | Williams | 209/667 |
| 5,425,459 | | 6/1995 | Ellis et al. | 209/671 |
| 5,480,034 | | 1/1996 | Kobayashi | 209/667 |
| 5,558,234 | | 9/1996 | Mobley | 209/671 |
| 5,590,792 | | 1/1997 | Kobayashi | 209/667 |
| 5,740,922 | * | 4/1998 | Williams | 209/668 |

* cited by examiner

*Primary Examiner*—Donald P. Walsh
*Assistant Examiner*—Daniel K Schlak
(74) *Attorney, Agent, or Firm*—Kirton & McConkie; Michael F. Krieger

(57) ABSTRACT

The present invention comprises a novel roller for use on agricultural produce grading, sorting, cleaning and conveying equipment. The roller comprises a cylindrical hub having protruding fingers thereon which extend outward from the hub in a direction perpendicular to the hub axis and inclined away from the direction of rotation of the hub. The roller further comprises lateral support shoulders which allow the fingers to flex properly in the direction of rotation while providing increased rigidity in a lateral direction to improve grading opening uniformity and consistency. A concave shape on the outer surface of these lateral support shoulders also defines an improved grading opening shape which serves to increase grading uniformity as well. A smooth surface to the grading opening surfaces also prevent accumulation of mud and dirt in the critical grading opening area.

27 Claims, 3 Drawing Sheets

LATERALLY REINFORCED PRODUCE ROLLER

THE FIELD OF THE INVENTION

This invention relates generally to the field of agricultural processing equipment and more specifically to equipment for grading, sorting, conveying and cleaning oblong and round produce. More particularly, the present invention is a roller for use on produce grading equipment with conveyors comprised of substantially parallel, driven roller shafts and is most suitable for use in processing potatoes and similar produce.

BACKGROUND

When produce such as potatoes, onions and other crops are harvested, the produce varies greatly in size, shape and weight. Different markets and customers often have disparate needs for produce of a given dimension or attribute. Frequently, produce of a given size or shape is in higher demand and will command a higher price. Consequently, harvested produce must be segregated according to size, shape or some other attribute to meet the needs of the customer and the market. Once sorted or graded, the produce of a specific size or characteristic may be shipped to the customer or market demanding that size or characteristic.

Potatoes, onions and other subterranean produce often have large amounts of soil and small rocks adhered to the produce when harvested. This material must be removed before the produce is weighed for sale. Soil removal can become difficult when the soil is relatively moist because the mud will adhere to equipment sometimes causing it to clog and sometimes causing it to become lubricated with a film of mud.

Potato harvesters often use a grading apparatus which comprises a succession of closely spaced roller shafts containing rollers with protrusions thereon which act to propel the potatoes along a grading path. The first roller shafts encountered by the potatoes are typically closely spaced with radial protrusions which serve to turn and propel the potatoes thereby loosening soil, rocks and mud which may have adhered to the potatoes. Subsequent sets of roller shafts are spaced increasingly further apart to allow the smaller and then larger grades of potatoes to pass between the rollers and fall into grading containers or conveyors for each grade of potato.

Problems may arise with this type of grader or sorter when excess mud is allowed to build up on the surfaces of the rollers. One problem occurs when mud builds up on the roller surfaces which define the opening through which the potatoes are graded. Mud buildup causes an effective decrease in the opening size and therefore a decrease in the potato size passing through the grader opening. Another problem occurs when roller surfaces become lubricated and clogged with mud such that potatoes are not properly propelled along the grader path. This causes potatoes to build up on the grader without forward movement. If this condition persists, potatoes accumulate and spill over the sides of the grader path putting a halt to grading operations.

Another problem occurs when grading rollers do not have proper elastic deflection during operation. Rollers and protrusions therefrom must deflect in a direction parallel with the grading path so as to prevent excessive impact forces on the produce. However, the protrusion must be sufficiently rigid to propel the produce along the grading path. Roller protrusions must also have sufficient lateral rigidity to retain a uniform shape through grading openings as produce is propelled across the openings. Proper protrusion rigidity contributes to uniform grading and efficient produce propulsion.

In reference to FIG. 1, a prior art roller may be used to illustrate the problems of the prior art. Prior art rollers, such as the "acorn" roller of FIG. 1, have tightly spaced ribs 2 and nubs 4 which create narrow crevices 6 where mud and dirt can easily accumulate. The concentration and density of the ribs 2 and nubs 4 also produces non-aggressive propulsion characteristics with no defined protrusions to grasp and propel the produce along the grading path. This lack of propulsion results in diminished production rates, especially in muddy conditions when the rollers are lubricated with mud.

The easy accumulation of mud and dirt in the many crevices 6 on the "acorn" roller also results in inaccurate sizing. In reference to FIG. 2 where a prior art "acorn" roller shaft layout is shown, it can be seen that these prior art roller are configured in such that the centerline 10 of each roller on a first shaft 14 aligns with the centerline 12 of each roller on the next successive shaft 16 thereby creating a somewhat distorted hexagonal pocket 20 or opening between rollers 14 and shafts 16 and 18.

Produce of a particular size or grade will fall within this opening 20 unless dirt and mud build up on the surface of rollers 14 thereby decreasing the size of opening 20 and consequently the size of the produce falling through the opening 20. It can also be seen that produce slightly larger than opening 20 will rest over opening 20 without being propelled down the grading path if an aggressive protrusion pattern is not available. This is often the case when tightly spaced ribs 2 and nubs 4 clog with dirt and mud.

SUMMARY AND OBJECTS OF THE INVENTION

The present invention comprises a novel roller for a produce grader roller shaft which provides improved produce propulsion and grading uniformity under muddy and dirty conditions.

Some embodiments of the present invention comprise an elastomeric roller preferably constructed of rubber or similar material. These embodiments of the present invention comprise a central cylindrical roller hub from which elongated fingers protrude in a direction perpendicular to the cylindrical axis of the hub. These fingers may be inclined away from the direction of rotation of the roller such that the base of the fingers leads the tips of the fingers during rotation. Additionally, the sides of these fingers are reinforced by lateral support shoulders which extend from the sides of the fingers outer surface of the roller hub thereby providing lateral support for the roller fingers. These lateral support shoulders are segregated by grooves which separate the shoulders of each distinct finger. This shoulder separation provides lateral support to the finger against excessive flexure in the lateral direction while allowing the finger to flex along its path of rotation so as to prevent excessive impact and bruising of the produce.

The outer surface of these shoulders also serves to define the shape and size of the grading openings between roller shafts. As potatoes are generally oval in shape, a substantially oval opening shape will provide the most uniform grading. This oval opening shape is achieved by giving the shoulders a concave outer surface shape. In this manner, two adjacent rollers will form a half-oval shape as one side of the grading opening thereby approximating an oval produce shape.

Accordingly, it is an object of some embodiments of the present invention to provide a produce grader with more uniform and reliable grading capacity.

It is another object of some embodiments of the present invention to provide a produce grader with increased propulsion capacity.

It is a further object of some embodiments of the present invention to provide a produce grader with improved capacity and accuracy under muddy and dirty conditions.

BRIEF DESCRIPTION OF THE DRAWINGS

In order that the manner in which the above-recited and other advantages and objects of the invention are obtained, a more particular description of the invention briefly depicted above will be rendered by reference to a specific embodiment thereof which is illustrated in the appended drawings. With the understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENT

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

The figures listed above are expressly incorporated as part of this detailed description.

Figure 1:
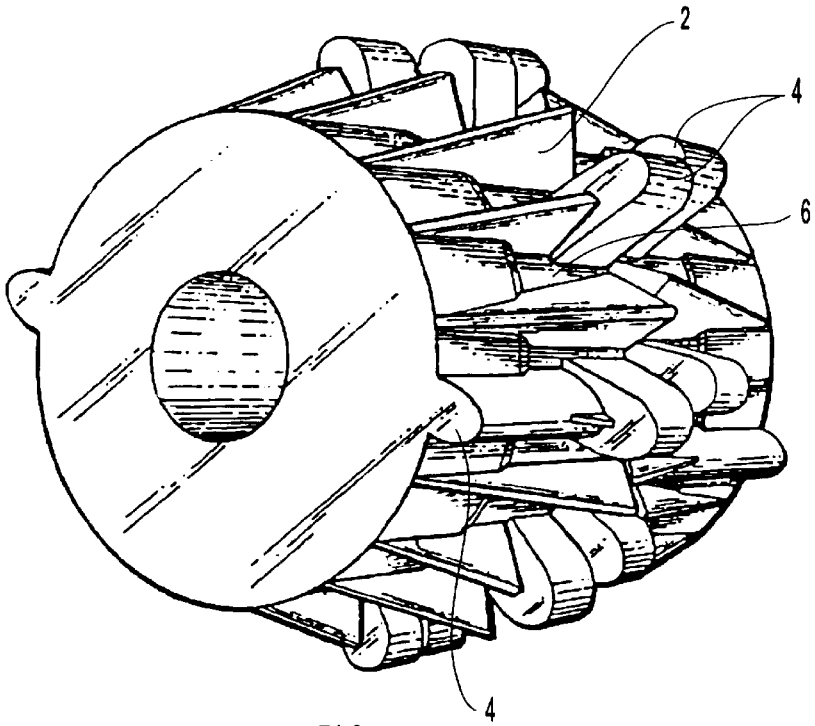
FIG. 1 (PRIOR ART)
FIG. 1 is a perspective view of a prior art "acorn " roller with tightly spaced ribs and nubs.
Figure 2:
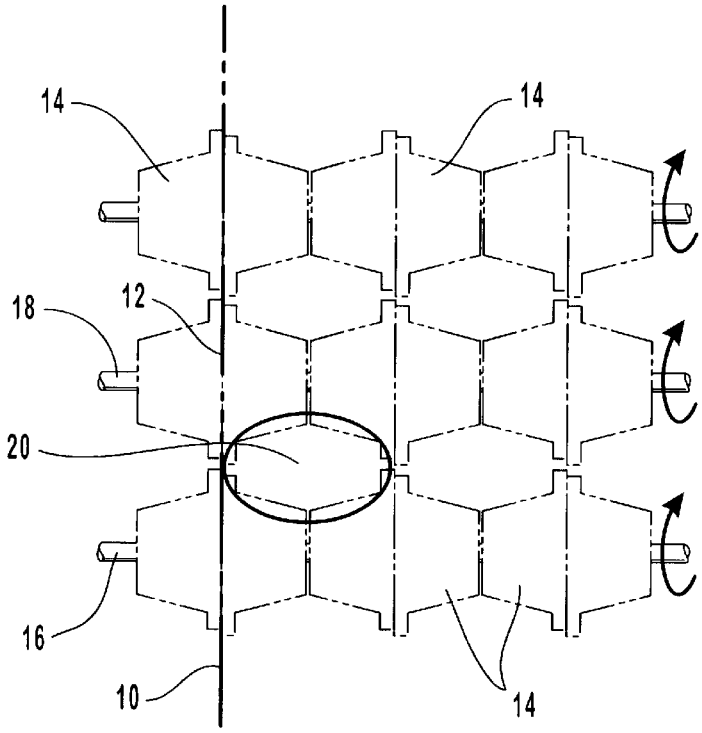
FIG. 2 (PRIOR ART)
FIG. 2 is a perspective view of an aligned roller shaft grader of the prior art using "acorn" rollers with tightly spaced ribs and nubs.
Figure 3:
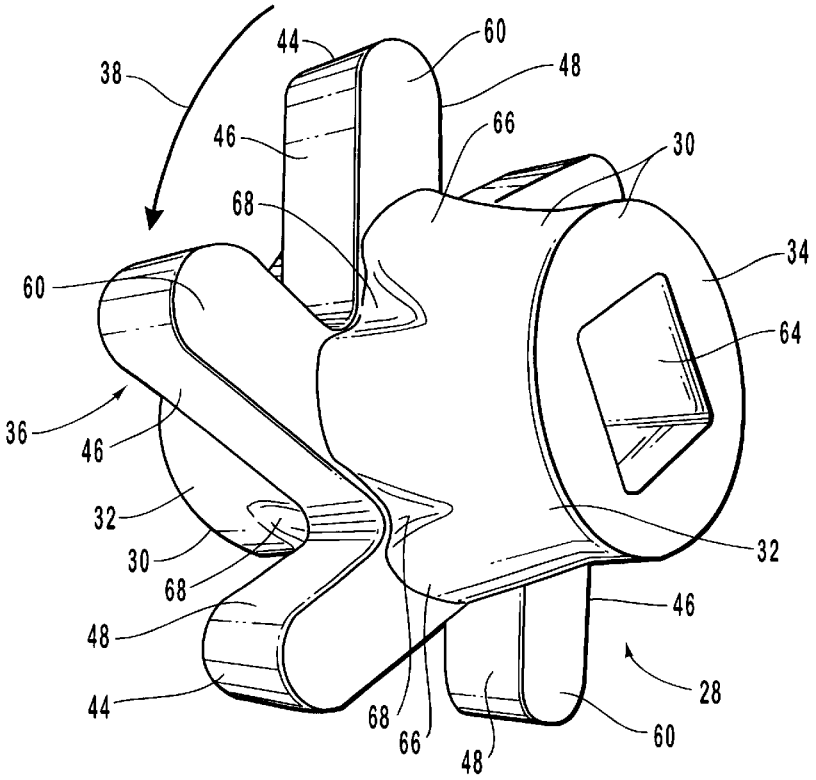
FIG. 3 is a perspective view of a roller of one embodiment of the present invention.
Figure 4:
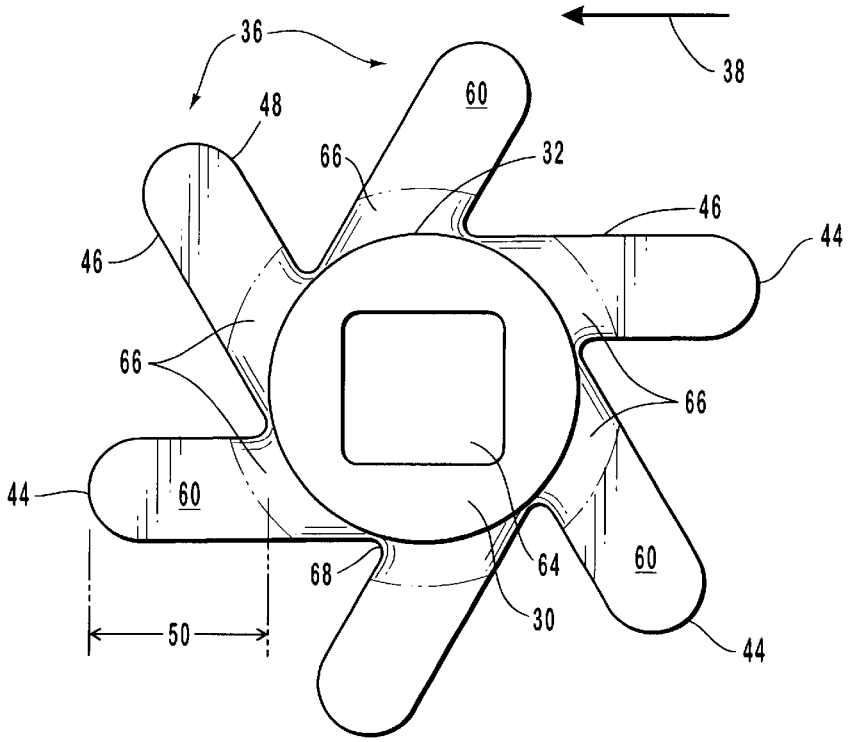
FIG. 4 is an elevational view of a roller of one embodiment of the present invention.
Figure 5:
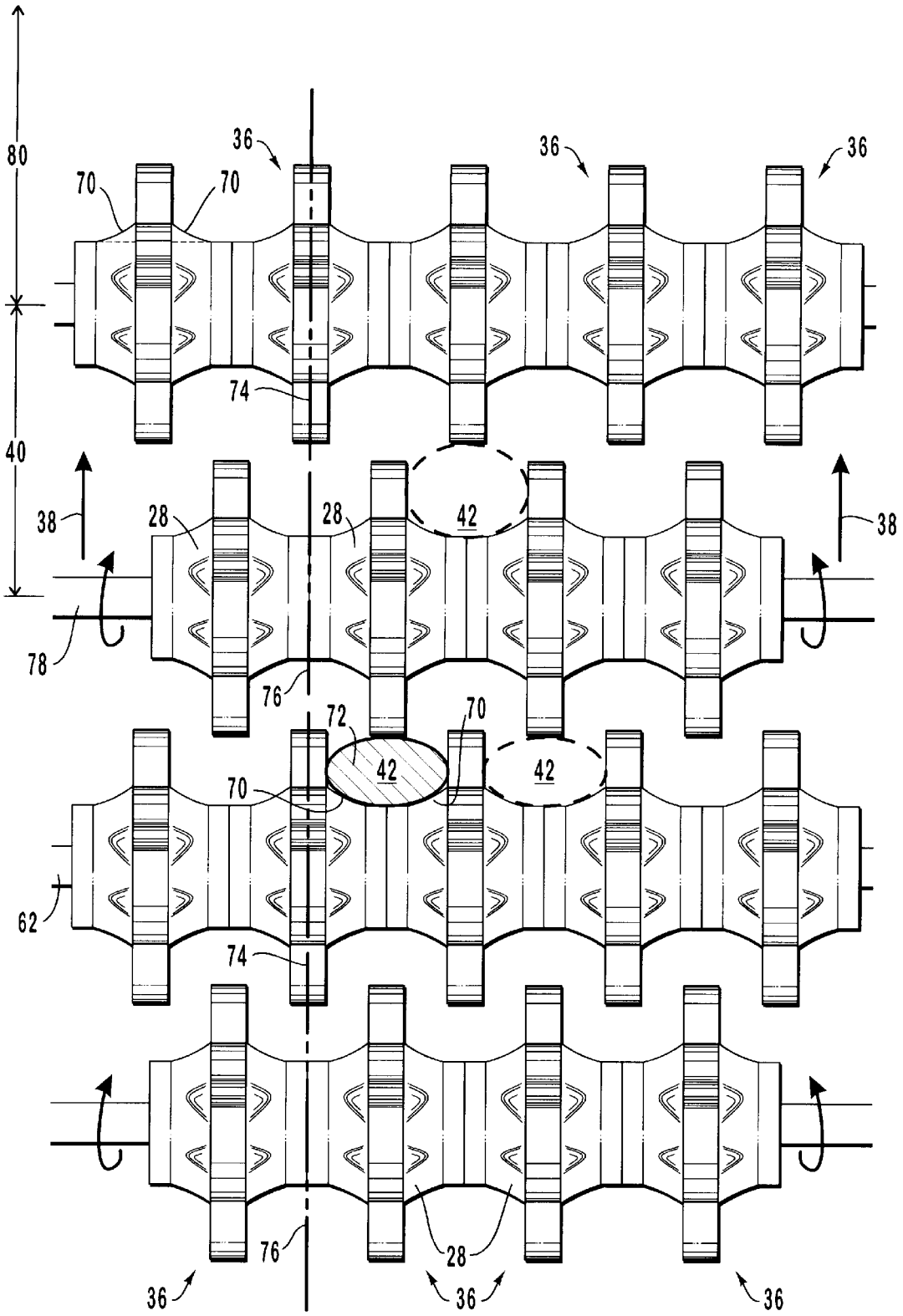
FIG. 5 is a top view of the rollers of an embodiment of the present invention on a grading apparatus with parallel shafts and offset rollers.

In reference to FIGS. 3–5, the novel features of some preferred embodiments of the present invention may be illustrated. Some embodiments of the present invention comprise a produce grading roller 28 having a substantially circular cylindrical roller hub 30 with a circular cylindrical outer surface 32. Flat hub ends 34 provide an abutting surface for arranging a series of adjacent rollers on a shaft. Propulsion fingers 36 propel produce along a grading path 38 with progressively higher roller spacing 40 which corresponds to progressively larger grades of produce. Eventually, the produce will fall through an opening 42 corresponding to a particular grade of produce or be ejected from the end of the grading path as oversize material.

Propulsion fingers 36 comprise elongate protrusions which preferably have rectangular or, more preferably, square cross-sections. A preferred embodiment of fingers 36 has a square cross-section with sides of about ¾" in length and works well in a potato grading process. However, other cross-sectional shapes and sizes will also work well with potatoes and other similar produce.

A preferred embodiment of fingers 36 also comprises a rounded tip 44 formed by the convergence of a leading surface 46 and a trailing surface 48. Fingers 36 protrude in a radial direction a protrusion distane 50 of approximately 1¼" to approximately 1¾" from the outer surface 32 of hub 30 to tip 44 with 1½" being a preferred distance for potato grading applications.

In preferred embodiments, fingers 36 will also be inclined away from a direction of rotation such that an extension of the leading surfaces 46 of fingers 36 will be substantially tangent to the outer cylindrical surface 32 of hub 30. This tangential relationship between leading surfaces 46 and may vary by about 15 degrees in either direction, however, a relationship very near to tangent is most preferable for potato grading applications.

In order to drive roller 28, a shaft 62 is placed through a series of adjacent rollers and connected to a rotating apparatus. Therefore, roller 28 comprises an axial drive aperture 64 extending completely through hub 30 for receiving a drive shaft 62.

A preferred embodiment of the present invention further comprises lateral support shoulders 66 which brace fingers 36 against lateral deflection. Shoulders 66 brace fingers 36 against lateral movement, but do not directly brace against movement in the direction of rotation. This allows fingers 36 to flex in the direction of rotation thereby giving fingers 36 a lighter touch on the produce being graded. However, shoulders 66 prevent lateral deflection thereby providing greater uniformity of grading as the grading opening 42 is not distorted by deflection of fingers 36 as produce contacts fingers 36. Shoulders 66 are segregated by grooves or saddles 68 which preferably extend inward to the outer cylindrical surface 32 of hub 30.

Shoulders 66 preferably have a concave outer surface 70, as shown in FIG. 5, which gives shoulders proper lateral rigidity and defines an improved grading opening shape 42. Concave outer surfaces 70 form a substantially half oval shape 72 for opening 42 which better approximates the shape of a potato or other round or oblong produce. This shape 72 provides more uniform grading as produce fits snugly into the opening without twisting or wedging into opening corners as in prior art openings.

A further advantage rendered by shoulders 66 is the ability to use higher compressive forces between rollers 28 on a shaft without distorting the shape of the rollers 28. Shoulders 66 reinforce the hub 30 of the roller 28 against compression so that rollers 28 can be compressed together on a shaft more tightly thereby reducing the possibility of foreign matter becoming entangled between rollers 28.

Lateral reinforcement provided by shoulders 66 also allows the use of a softer rubber or similar elastomeric material as lateral rigidity comparable to harder rubbers can be achieved with a softer rubber reinforced with shoulders 66. Softer rubber rollers damage produce less and render the equipment more versatile by allowing use with more tender produce.

When produce which is slightly larger than opening 42 falls onto openings it is summarily ejected by fingers 36 on rollers found on the next successive roller shaft. Fingers on these rollers will positively engage oversize produce and propel it to the next grading opening 42 which will eventually be a larger grade or size.

It should be noted that the preferred roller embodiments of the present invention are preferably configured in an offset roller configuration wherein rollers on a first roller shaft 62 have a centerline 74 which aligns with a dividing line 76 between rollers 28 on a next subsequent roller shaft 78. In this offset configuration, fingers 36 on rollers 28 define a portion of grading opening 42 and serve as positive ejectors of oversize produce. This configuration, using the novel rollers 28 of the present invention, increases grading capacity, throughput, speed and accuracy as well as reliability in adverse conditions of mud and dirt.

Another advantage of the present invention derives from the smoothness of the surfaces which define the grading opening 42. These surfaces may include the exposed surfaces of shoulders 66, outer hub surface 32, grooves or saddles 68, and the sides of fingers 36 as well as other surfaces which may help define the grading opening in embodiments of the present invention. These grading opening surfaces are preferably smooth with rounded edges and radius transitions between surfaces. This smoothness serves to inhibit accumulation of dirt, mud and other deleterious materials and preserve the uniformity of the grading opening size and dimensions.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed is:

1. A produce processing roller for use with other contiguous rollers comprising:

a cylindrical hub having flat outer ends and an axial drive aperture;

a plurality of fingers protruding in a direction generally tangential to an axis of the hub; and lateral support shoulders with concave outer surfaces extending adjacent the fingers to the outer end of the hub wherein a generally half oval curve is formed when two rollers are placed adjacent and coaxially one another.

2. The roller of claim 1 wherein said axial drive aperture has a square cross-section.

3. The roller of claim 1 wherein said fingers have a rectangular cross-section.

4. The roller of claim 1 wherein said fingers have a square cross-section.

5. The roller of claim 4 wherein said square cross-section has sides measuring from about ½" to about 1".

6. The roller of claim 4 wherein said square cross-section has sides measuring about ¾".

7. The roller of claim 1 wherein said fingers have a leading surface, a trailing surface, a right side and a left side and said trailing surface and said leading surface converge to form a rounded tip.

8. The roller of claim 1 wherein the fingers fixedly incline or decline from tangent between 0–15 degrees.

9. The roller of claim 1 wherein said lateral support shoulders include grooves located between each finger of said plurality of fingers.

10. An agricultural processing apparatus comprising:

a plurality of successive, substantially parallel drive shafts, each drive shaft having a plurality of rollers thereon, each roller having a given width wherein the rollers are offset generally one half roller width of the rollers on the preceding shaft;

each roller comprising:

a round cylindrical hub having an axial drive aperture to accommodate one of the shafts and an outer surface;

a plurality of fingers protruding in a direction generally tangential to a cylindrical axis of the hub;

lateral support shoulders with curved outer surfaces extending from sides of the fingers to the outer surface of the hub wherein coaxially adjacent rollers form a generally half oval opening along the shoulder portions.

11. The roller of claim 10 wherein said axial drive aperture has a square cross-section.

12. The roller of claim 10 wherein said fingers have a rectangular cross-section.

13. The roller of claim 10 wherein said fingers have a square cross-section.

14. The roller of claim 13 wherein said square cross-section has sides measuring from about ½" to about 1".

15. The roller of claim 13 wherein said square cross-section has sides measuring about ¾".

16. The roller of claim 10 wherein said fingers have a leading surface, a trailing surface, a right side and a left side and said trailing surface and said leading surface converge to form a rounded tip.

17. The roller of claim 10 wherein the fingers incline or decline from tangent by about 15 degrees.

18. The roller of claim 10 wherein said lateral support shoulders include grooves located between each finger of said plurality of fingers.

19. A produce sizing, grading, cleaning and conveying apparatus comprising:

a plurality of successive, substantially parallel drive shafts, each shaft having a plurality of rollers thereon, said rollers being laterally offset such that a centerline at the center of each roller on a one of said shafts aligns with a dividing line between said rollers on a next successive shaft;

each roller comprising:

a round cylindrical hub having a pair of flat ends and an axial drive aperture to accommodate one of the shafts;

a plurality of fingers protruding in a direction generally tangential to a cylindrical axis of the hub;

lateral support shoulders with concave outer surfaces extending from the fingers to at least one flat end of the hub thereby forming a generally half oval opening between coaxially adjacent rollers.

20. The roller of claim 19 wherein said axial drive aperture has a square cross-section.

21. The roller of claim 19 wherein said fingers have a rectangular cross-section.

22. The roller of claim 19 wherein said fingers have a square cross-section.

23. The roller of claim 22 wherein said square cross-section has sides measuring from about ½" to about 1".

24. The roller of claim 22 wherein said square cross-section has sides measuring about ¾".

25. The roller of claim 19 wherein said fingers have a leading surface, a trailing surface, a right side and a left side and said trailing surface and said leading surface converge to form a rounded tip.

26. The roller of claim 19 wherein the fingers incline or decline from tangent by about 15 degrees.

27. The roller of claim 19 wherein said lateral support shoulders include grooves located between each finger of said plurality of fingers.

* * * * *